US009577393B2

(12) United States Patent
Ho

(10) Patent No.: US 9,577,393 B2
(45) Date of Patent: Feb. 21, 2017

(54) CONNECTOR FOR WEARABLE DEVICE

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/795,950

(22) Filed: Jul. 10, 2015

(65) Prior Publication Data

US 2016/0190733 A1 Jun. 30, 2016

(30) Foreign Application Priority Data

Jul. 11, 2014 (TW) ..... 103212387 U

(51) Int. Cl.

| | |
|---|---|
| ***H01R 24/62*** | (2011.01) |
| ***H01R 13/46*** | (2006.01) |
| ***H01R 43/24*** | (2006.01) |
| *H01R 13/62* | (2006.01) |
| *H01R 13/405* | (2006.01) |

(52) U.S. Cl.

CPC ..... *H01R 24/62* (2013.01); *H01R 13/465* (2013.01); *H01R 43/24* (2013.01); *H01R 13/405* (2013.01); *H01R 13/6205* (2013.01)

(58) Field of Classification Search

CPC ..... H01R 24/62

See application file for complete search history.

(56) References Cited

U.S. PATENT DOCUMENTS

| | | | | |
|---|---|---|---|---|
| 4,572,878 | A * | 2/1986 | Daugherty | G01K 1/14 374/E1.018 |
| 5,261,834 | A * | 11/1993 | Yamanashi | H01R 13/424 439/595 |
| 7,311,526 | B2 * | 12/2007 | Rohrbach | H01R 13/6205 439/218 |
| 8,088,043 | B2 * | 1/2012 | Andren | A63B 24/00 368/10 |
| 8,469,862 | B2 | 6/2013 | Andren et al. | |
| 2006/0140055 | A1 * | 6/2006 | Ehrsam | A44C 5/18 368/10 |
| 2006/0145663 | A1 * | 7/2006 | Shiff | H01R 13/6205 320/125 |
| 2006/0261958 | A1 * | 11/2006 | Klein | A01K 11/006 340/572.8 |
| 2007/0064542 | A1 * | 3/2007 | Fukushima | G04B 37/1486 368/282 |
| 2007/0066088 | A1 * | 3/2007 | Rambosek | H05K 5/0278 439/37 |
| 2007/0072442 | A1 * | 3/2007 | DiFonzo | H01R 13/641 439/39 |
| 2010/0217096 | A1 | 8/2010 | Nanikashvili | |

(Continued)

FOREIGN PATENT DOCUMENTS

| | | |
|---|---|---|
| TW | M448000 U | 3/2013 |
| TW | M450094 U | 4/2013 |

*Primary Examiner* — James Harvey

(74) *Attorney, Agent, or Firm* — James A. O'Malley

(57) ABSTRACT

An electrical connector comprises an insulative housing, a positioning member and a plurality of first terminals. The insulative housing has a tongue. The positioning member is embedded in the tongue and has a main body. The plurality of first terminals are held by the main body of the positioning member and embedded in the insulative housing. The tongue exposes a flat plate-like contact portion of each first terminal.

18 Claims, 15 Drawing Sheets

(56) References Cited

U.S. PATENT DOCUMENTS

| | | | | |
|---|---|---|---|---|
| 2013/0273773 | A1* | 10/2013 | Lan | H01R 12/57<br>439/566 |
| 2014/0170906 | A1* | 6/2014 | Ho | H01R 13/44<br>439/676 |

* cited by examiner

CONNECTOR FOR WEARABLE DEVICE

RELATED APPLICATIONS

This application claims priority to Taiwanese Application No. 103212387, filed Jul. 11, 2014, which is incorporated herein by reference in its entirety.

TECHNICAL FIELD

The present disclosure relates to an electrical connector and an electronic device with the electrical connector, and more specifically to an electrical connector with a tongue and an electronic device with the electrical connector.

BACKGROUND ART

Generally, an electrical connector comprises an insulative housing and a plurality of terminals, here are two common manners for engaging the plurality of terminals with the insulative housing. One manner is that the insulative housing and the plurality of terminals are formed respectively, then the plurality of terminals are mounted to the insulative housing. Another manner is that the insulative housing is formed by insert molding and the plurality of terminals are embedded in the insulative housing at the same time during insert molding. It is required to fix the plurality of terminals in a mold during the molding process so as to avoid flowing of melt plastic causing the plurality of terminals to move in position when the melt plastic is injected into the mold.

In existing ways of fixing the plurality of terminals, ejector pins are usually used so as to fix each terminal in a predetermined position. However, the position where the ejector pin is provided will leave a pin hole after the insulative housing is formed. For example, Taiwanese patent issued as TWM450094 discloses an electrical connector in which pin holes, which are formed by removing the ejector pins, are left on a tongue of the insulative housing adjacent to two sides of flat plate-like contact portion of each terminal. So it not only damages the structure of the tongue, but also affects the beauty of the tongue.

Furthermore, some electrical connectors may be provided with logo patterns, such as trademark, on a surface of the insulative housing. Logo patterns are usually formed on the insulative housing by printing or imprinting, but logo patterns formed by those ways are easily worn to disappear.

SUMMARY OF THE INVENTION

An electrical connector of the present disclosure comprises an insulative housing, a positioning member and a plurality of first terminals. The insulative housing has a tongue. The positioning member is embedded in the tongue and has a main body. The plurality of first terminals are held by the main body of the positioning member and are embedded in the insulative housing, each first terminal having a flat plate-like contact portion exposing from the tongue.

In an embodiment, the positioning member further has a display portion protruding from a surface of the main body and the display portion is far away from the surface of the main body and the tongue exposes the display portion.

In an embodiment, the display portion is character or graphics.

In an embodiment, a colour of the display portion is different from a colour of the tongue.

In an embodiment, the main body of the positioning member has a plurality of holding holes, each first terminal further has a holding portion bent from an end of the contact portion and extending, the holding portions of the plurality of first terminals correspondingly extend into the plurality of holding holes respectively.

In an embodiment, the main body of the positioning member further has two positioning holes) positioned at two opposite sides of the plurality of holding holes, the tongue has two latch holes respectively corresponding to the two positioning holes in position.

In an embodiment, the electrical connector further comprises: a plurality of second terminals provided to the insulative housing, each second terminal has an elastic contact portion, from the surface of the tongue, the elastic contact portions of the plurality of second terminals and the contact portions of the plurality of first terminals are exposed at the same side.

In an embodiment, the contact portions of the plurality of first terminals and the contact portions of the plurality of second terminals are provided as two rows along a mating direction.

An electronic device of the present disclosure comprises: a circuit board, an electrical connector as above and a wear piece. The electrical connector is provided to the circuit board and is electrically connected to the circuit board. The wear piece has a first end portion and a second end portion which can be repeatedly engaged oppositely, and the wear piece being a ring shape when the first end portion and the second end portion are engaged, the circuit board and the electrical connector are provided at the first end portion and the tongue protrudes from the first end portion, the second end portion has a receiving groove for receiving the tongue, and the tongue is received in the receiving groove when the first end portion and the second end portion are engaged.

In an embodiment, the first end portion and the second end portion are engaged with each other by magnetic attraction.

In an embodiment, the second end portion further has a latch block protruding into the receiving groove, and the tongue has a latch groove for latching of the latch block.

In an embodiment, another electronic device of the present disclosure comprises a circuit board, an electrical connector as above and a shell. The electrical connector is provided to the circuit board and is electrically connected to the circuit board. The shell covers the circuit board and a part of the electrical connector so as to make the tongue protrude relative to an end of the shell.

The effects of the present disclosure are as follows: that the plurality of first terminals are held by the positioning member may reduce the number of the ejector pins in the molding process, and does not leave the pin holes on the tongue at the two sides and the back surface of the contact portion of each first terminal so as to make the structure of the tongue integrated and beautiful. Furthermore, it seems that the display portion of the positioning member is embedded in the tongue, as such the display portion is not easily worn to disappear. Furthermore, the colour of the display portion may be different from the colour of the tongue so as to highlight the display portion.

BRIEF DESCRIPTION OF THE DRAWINGS

The other features and effects of the present disclosure will present clearly in the detailed description in combination with the accompanying figures, and in which.

DETAILED DESCRIPTION OF THE PREFERRED EMBODIMENTS

Figure 1:
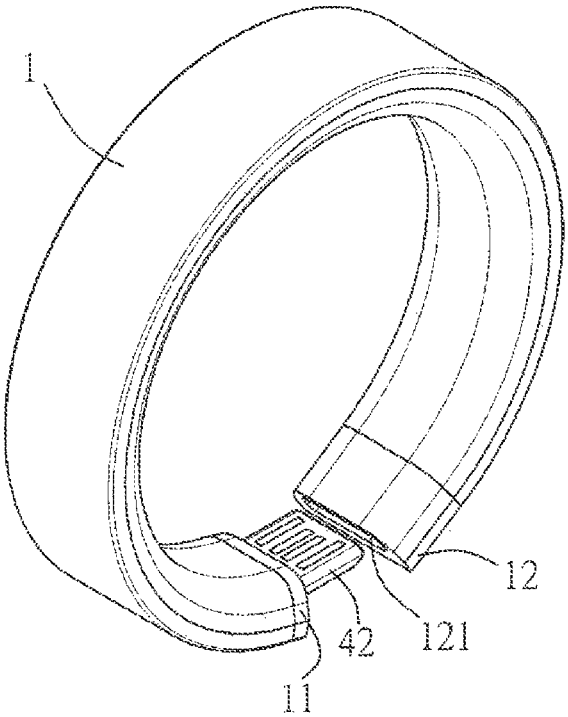
FIG. 1 illustrates a perspective view of a first embodiment of an electronic device.
Figure 2:
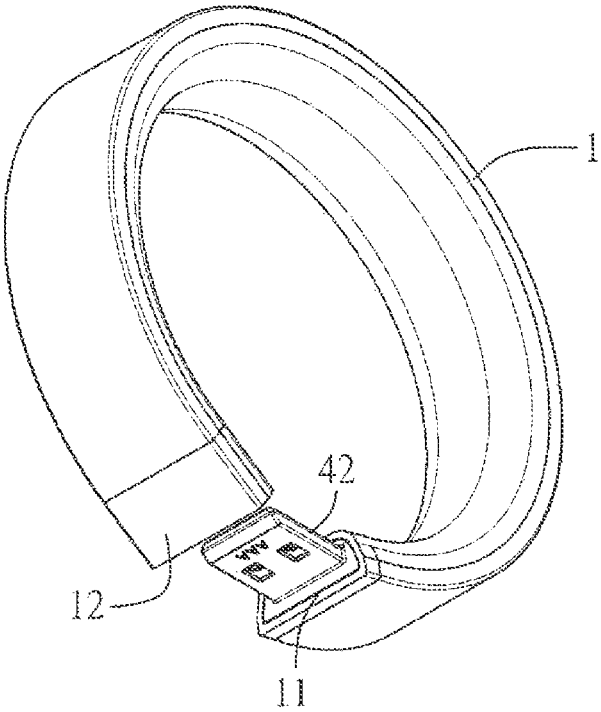
FIG. 2 illustrates another perspective view of the embodiment depicted in FIG. 1.
Figure 3:
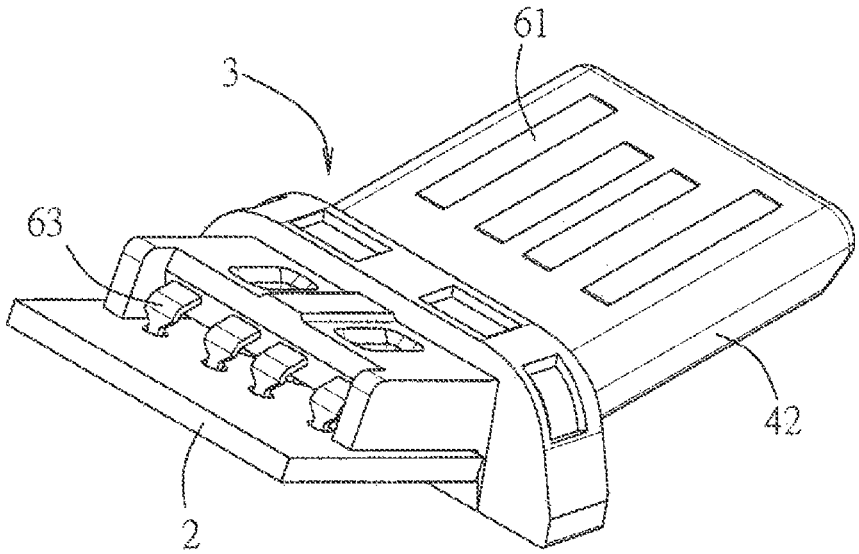
FIG. 3 illustrates a perspective view of an embodiment of an electrical connector mounted on a circuit board.
Figure 4:
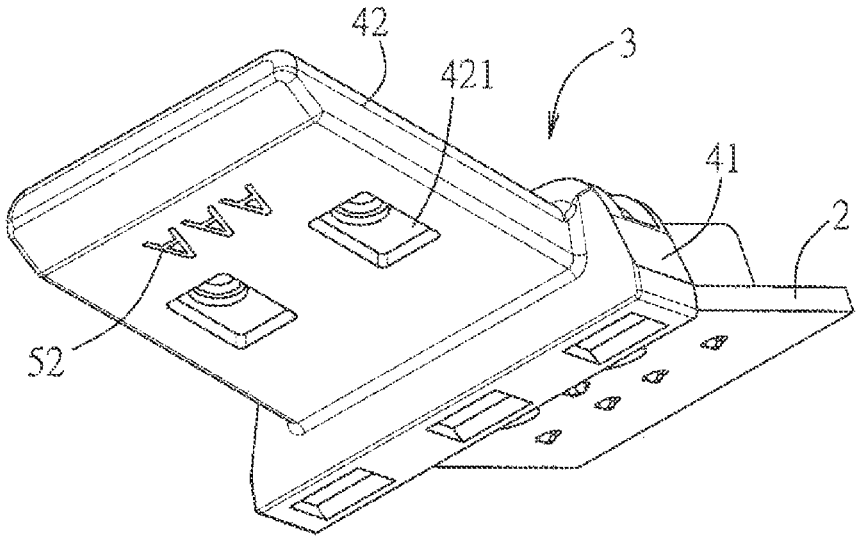
FIG. 4 illustrates another perspective view of the embodiment depicted in FIG. 3.
Figure 5:
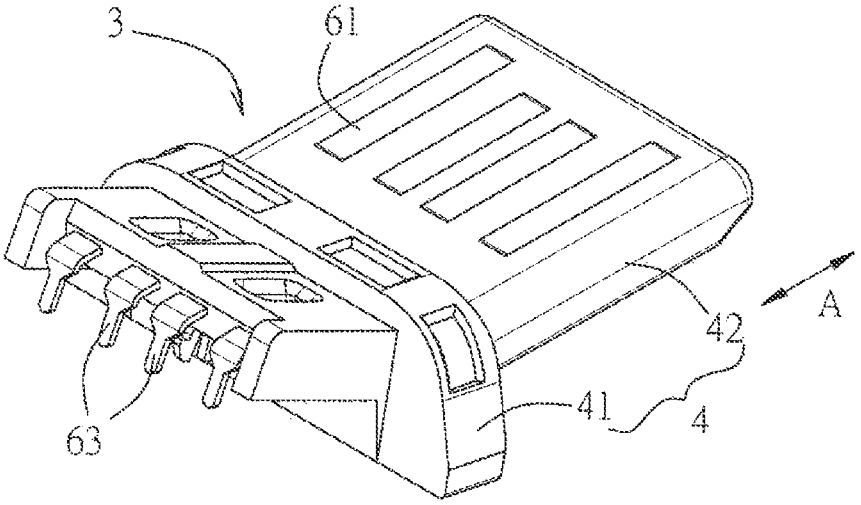
FIG. 5 illustrates a perspective view of an embodiment of the connector depicted in FIG. 3.
Figure 6:
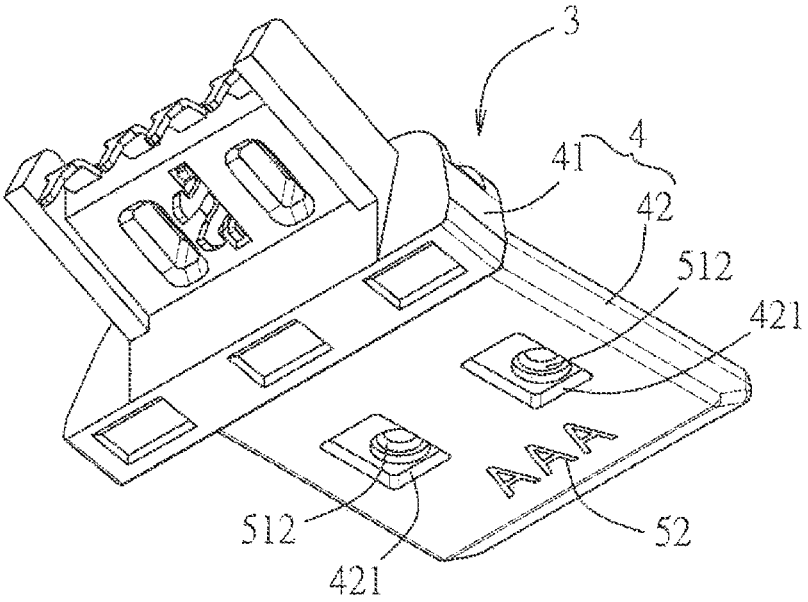
FIG. 6 illustrates another perspective view of the embodiment depicted in FIG. 5.
Figure 7:
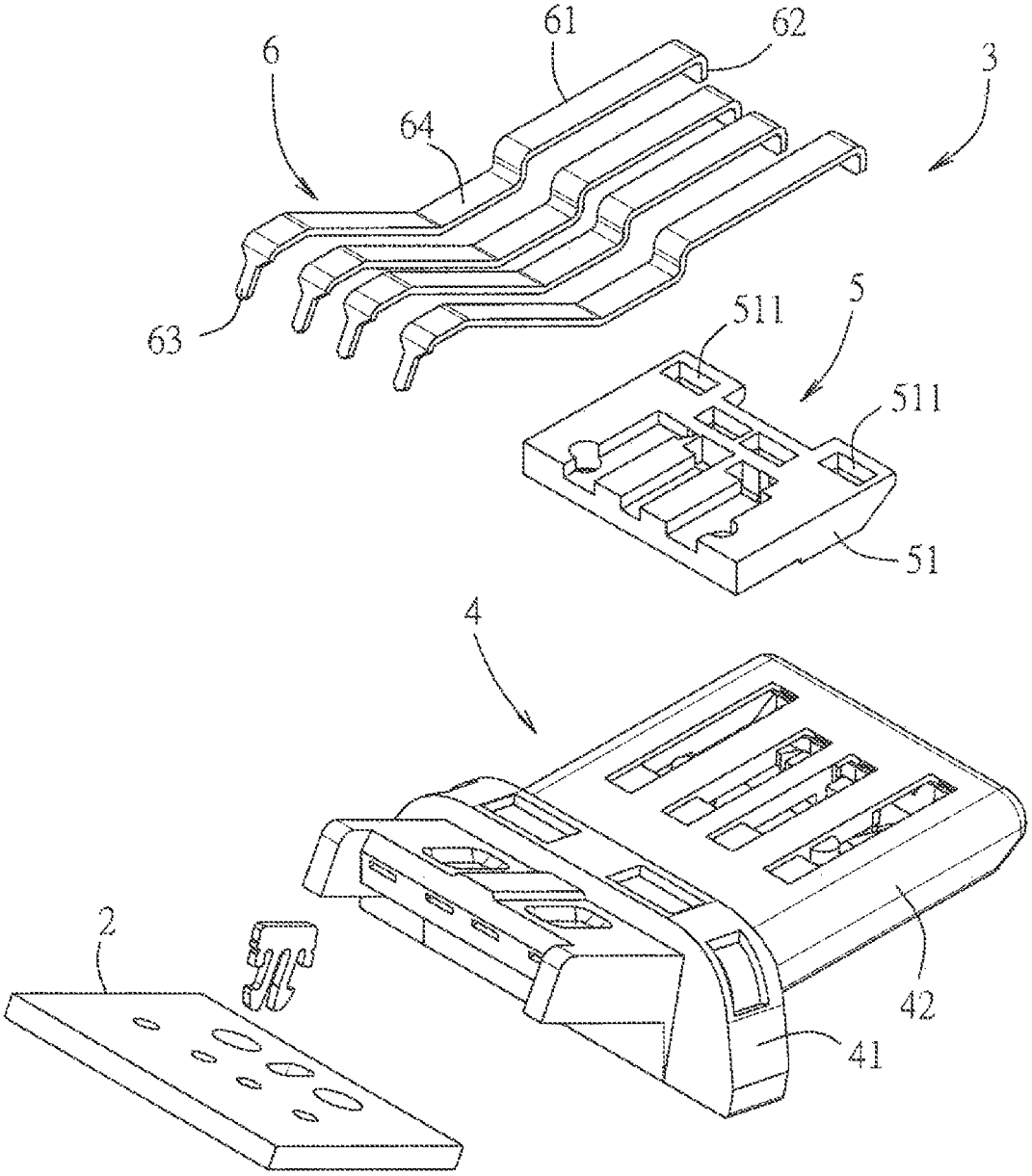
FIG. 7 illustrates an exploded perspective view of an embodiment of the electrical connector depicted in FIG. 5.
Figure 8:
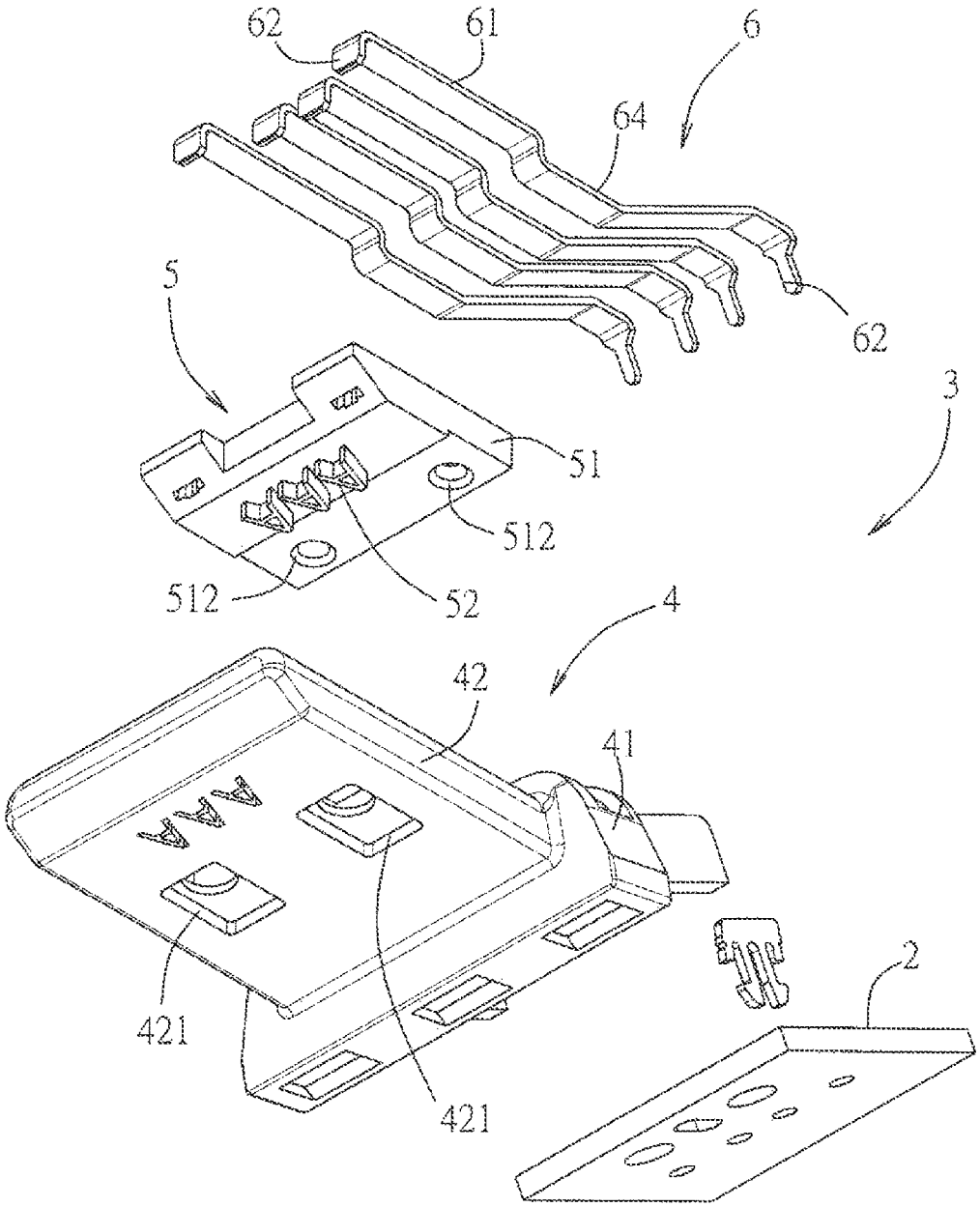
FIG. 8 illustrates another exploded perspective view of an embodiment depicted in FIG. 7.
Figure 9:
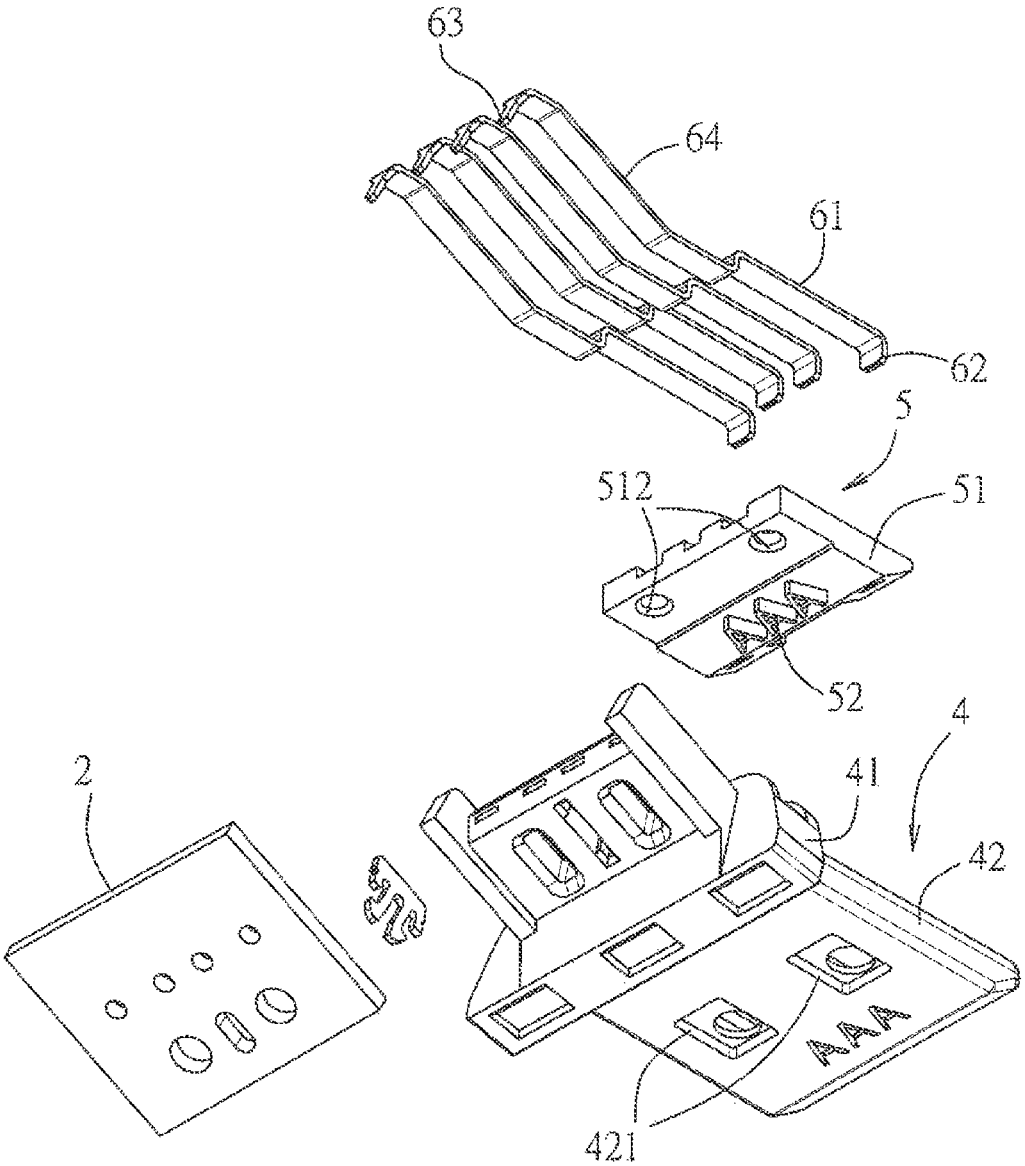
FIG. 9 illustrates another exploded perspective view of an embodiment depicted in FIG. 7.
Figure 10:
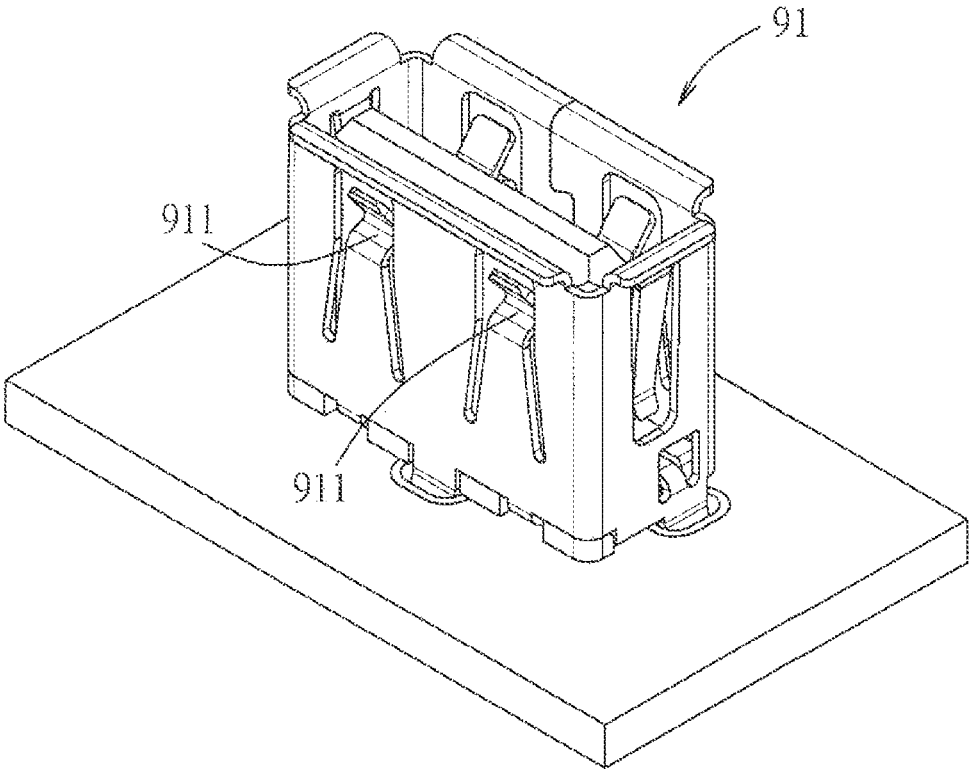
FIG. 10 illustrates a perspective view of an embodiment of a mating connector configured to mate with the electrical connector depicted in FIG. 5.

Before the present disclosure is described in detail, it should be noted that similar components are indicated as the same reference numeral in the following description.

As can be appreciated from the disclosure, an object of the present disclosure is to provide an electrical connector which may resolve the above noted problems. Another object of the present disclosure is to provide an electronic device with the electrical connector.

Referring to FIG. 1 to FIG. 4, an electronic device of a first embodiment of the present disclosure comprises a wear piece 1, a circuit board 2 and an electrical connector 3.

The wear piece 1 has a first end portion 11 and a second end portion 12 which may be repeatedly engaged oppositely, and the wear piece 1 is a ring shape when the first end portion 11 and the second end portion 12 are engaged. In the embodiment, a ring body of the wear piece 1 is made of plastic, the first end portion 11 and the second end portion 12 are made of magnetic material respectively so as to make the first end portion 11 and the second end portion 12 engaged with each other by magnetic attraction, of course, one of the first end portion 11 and the second end portion 12 is made of magnetic material and the other of the first end portion 11 and the second end portion 12 is made of metal which can be attracted by magnetic attraction so as to similarly make the first end portion 11 and the second end portion 12 engaged with each other by magnetic attraction. The electrical connector 3 is provided on the circuit board 2 and is electrically connected to the circuit board 2. Also, the circuit board 2 and the electrical connector 3 are provided on the first end portion 11.

Referring to FIG. 5 to FIG. 9, the electrical connector 3 comprises an insulative housing 4, a positioning member 5 and a plurality of first terminals 6. The insulative housing 4 has a base portion 41, a tongue 42 extending from the base portion 41 along a mating direction A. The positioning member 5 has a main body 51 and a display portion 52 protruding from a surface of the main body 51. The main body 51 has a plurality of holding holes 511 and two positioning holes 512 positioned at two opposite sides of the plurality of holding holes 511. The display portion 52 has a marking function, in the embodiment, the display portion 52 and the two positioning holes 512 are positioned at the same side of the main body 51, but in an equivalent embodiment, the display portion 52 and the plurality of the holding hole 511 may be positioned at the same side. The display portion 52 may be character or graphics, and may be designed according to application requirements in using the design. Each first terminal 6 has a flat plate-like contact portion 61, a holding portion 62 bent from an end of the contact portion 61 and extending, a tail portion 63 positioned at an opposite end of the holding portion 62, and a body portion 64 connecting the contact portion 61 and the tail portion 63. The holding portions 62 of the plurality of first terminals 6 correspondingly extend into the plurality of holding holes 511 of the positioning member 5 respectively and the plurality of contact portions 61 abut against the surface of the main body 51 so as to be held by the main body 51 of the positioning member 5. In the embodiment, the insulative housing 4 is formed by insert molding, the plurality of first terminals 6 are positioned in the mold (not shown) by the positioning member 5 so as to avoid the plurality of first terminals 6 moving in molding process of the insulative housing 4. The two positioning holes 512 of the positioning member 5 are used for insertion of the ejector pins (not shown) so as to hold the positioning member 5 in the molding process. After the insulative housing 4 is formed, the positioning member 5 is embedded in the tongue 42, the plurality of first terminals 6 are embedded in the insulative housing 4, but the tongue 42 exposes the flat plate-like contact portion 61 and the tail portion 63 protrudes relative to the base portion 41. The tongue 42 has two latch holes 421 corresponding respectively to the two positioning holes 512 in position. The two latch holes 421 are also used for insertion of the ejector pins so as to hold the positioning member 5 in the molding process, and after molding, the two latch holes 42 are used for latching of resilient arms 911 of a mating connector 91 when the electrical connector 3 is mated with the mating connector 91. That the plurality of first terminals 6 are positioned by the positioning member 5 may reduce the number of the ejector pins in the molding process, and does not leave pin holes on the tongue 42 at two sides and a back surface of the contact portion 61 of the each first terminal 6 so as to make the structure of the tongue 42 integrated and beautiful.

The display portion 52 of the positioning member 5 is far away from the surface of the main body 51 and the tongue 42 exposes the display portion 52, it seems the display portion 52 is embedded in the tongue 42, as such, the display portion 52 is not easily worn to disappear. In the embodiment, the insulative housing 4 and the positioning member 5 are respectively made of the plastic materials in different colours, so as to make the colour of the display portion 52 different from the colour of the tongue 42, thereby highlighting the display portion 52.

Referring to FIG. 1 to FIG. 4, the electrical connector 3 and the circuit board 2 together are provided to the wear piece 1, only the tongue 42 protrudes from the first end portion 11, the second end portion 12 has a receiving groove 121 for receiving the tongue 42, and when the first end portion 11 and the second end portion 12 are engaged, the tongue 42 is received in the receiving groove 121.

Figure 11:
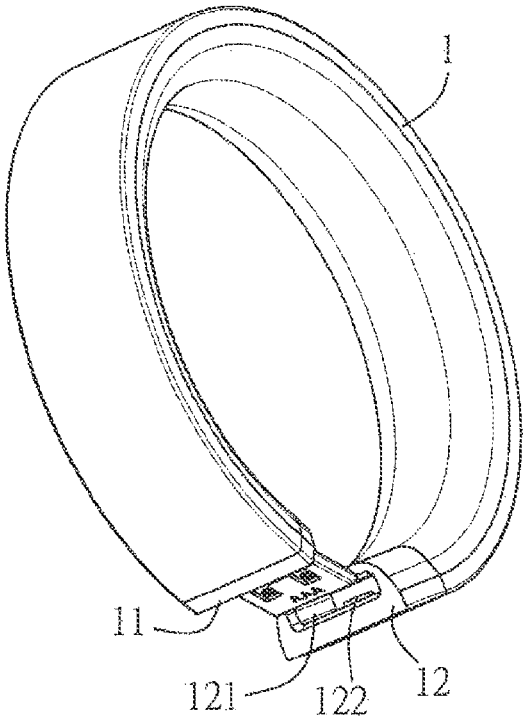
FIG. 11 illustrates a perspective view of a second embodiment of an electronic device.
Figure 12:
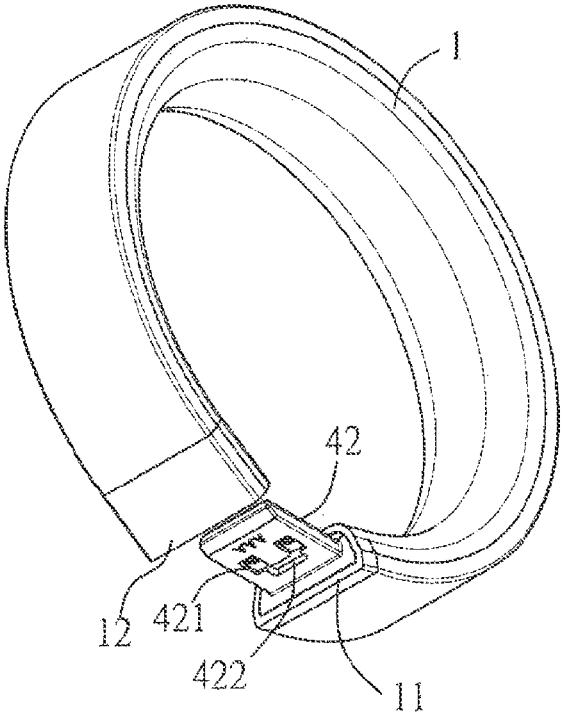
FIG. 12 illustrates another perspective view of the embodiment depicted in FIG. 11.
Figure 13:
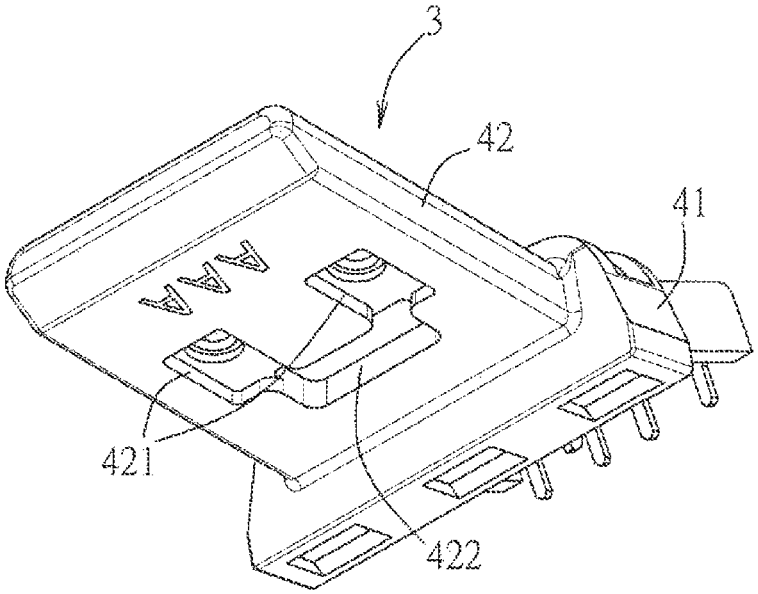
FIG. 13 is a perspective view illustrating an electrical connector suitable for use in the embodiment depicted in FIG. 11.
Figure 14:
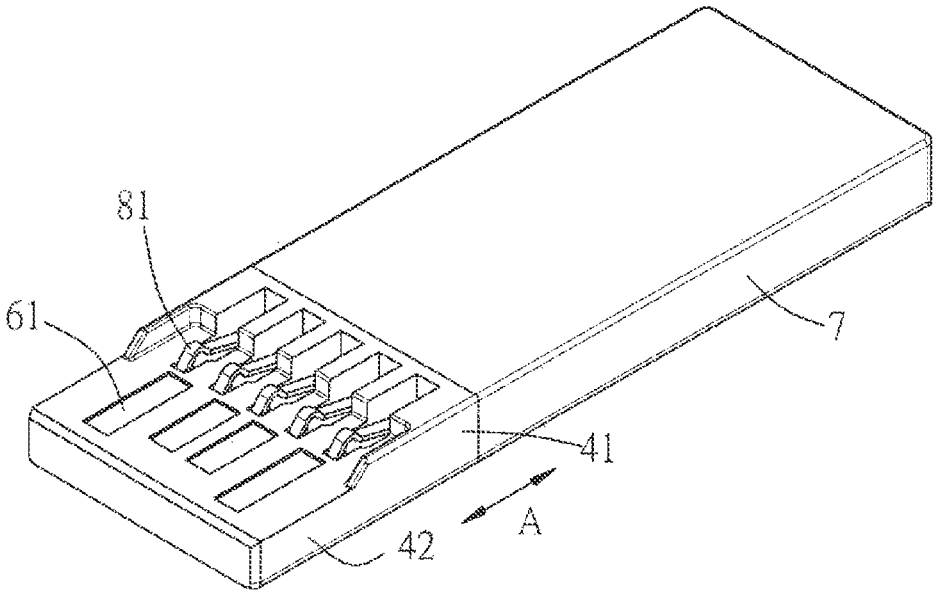
FIG. 14 illustrates a perspective view of a third embodiment of an electronic device.
Figure 15:
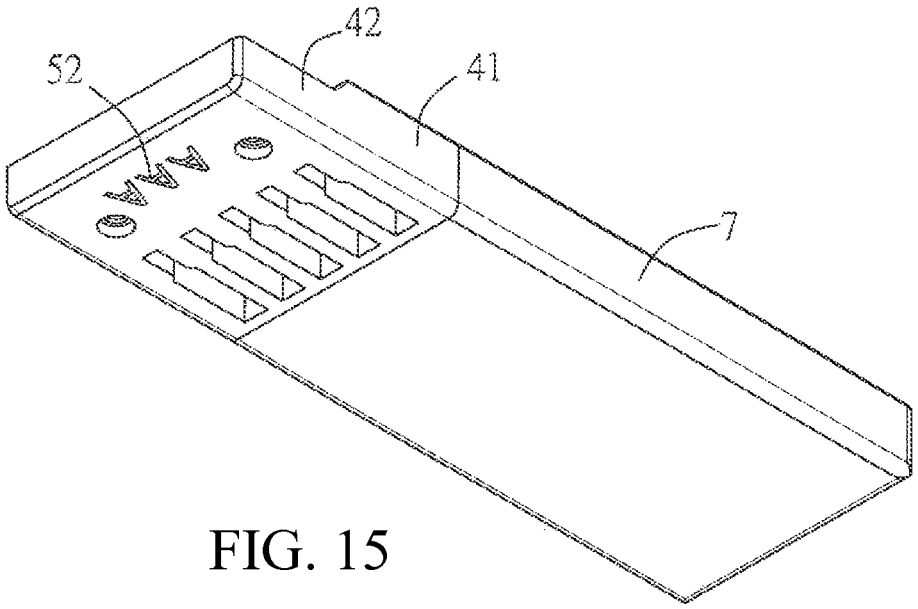
FIG. 15 illustrates another perspective view of the embodiment depicted in FIG. 14.
Figure 16:
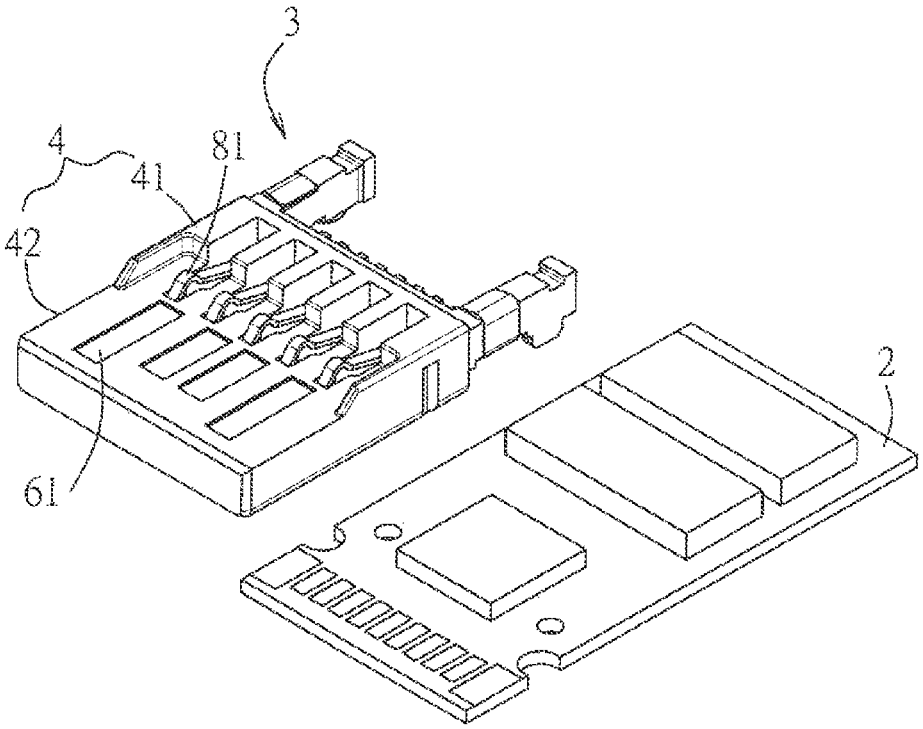
FIG. 16 illustrates an exploded, simplified perspective view of the embodiment depicted in FIG. 14.
Figure 17:
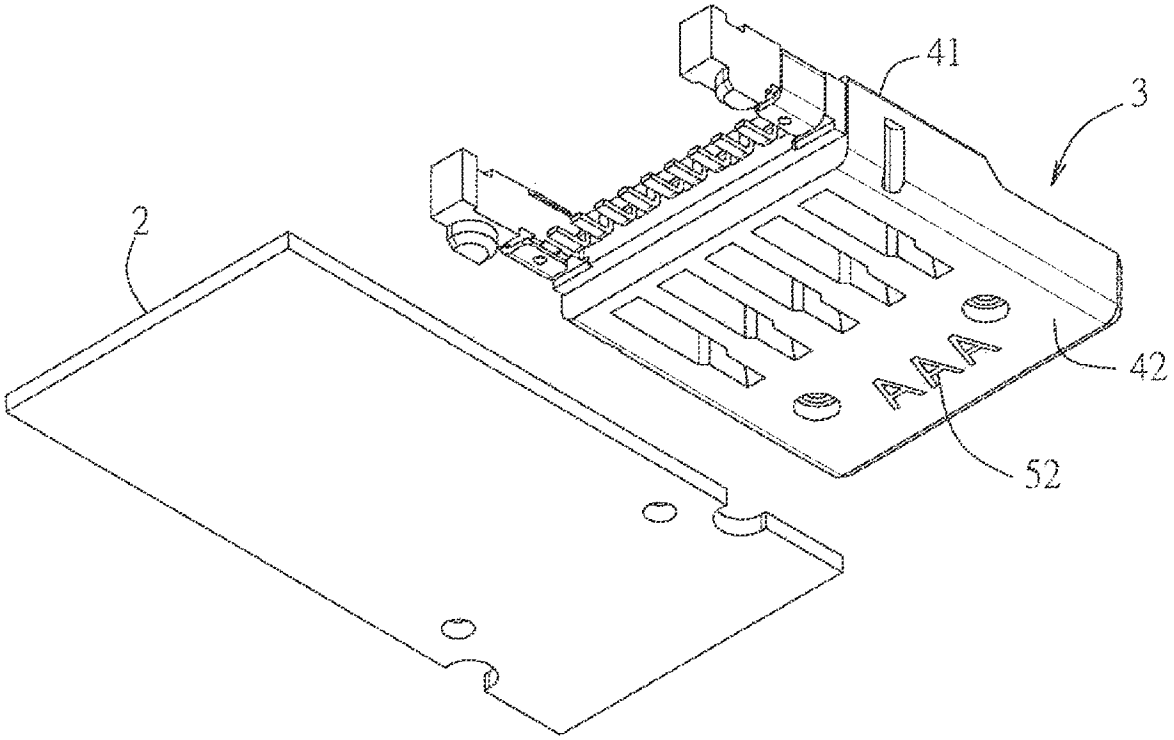
FIG. 17 illustrates another perspective view of the embodiment depicted in FIG. 16.
Figure 18:
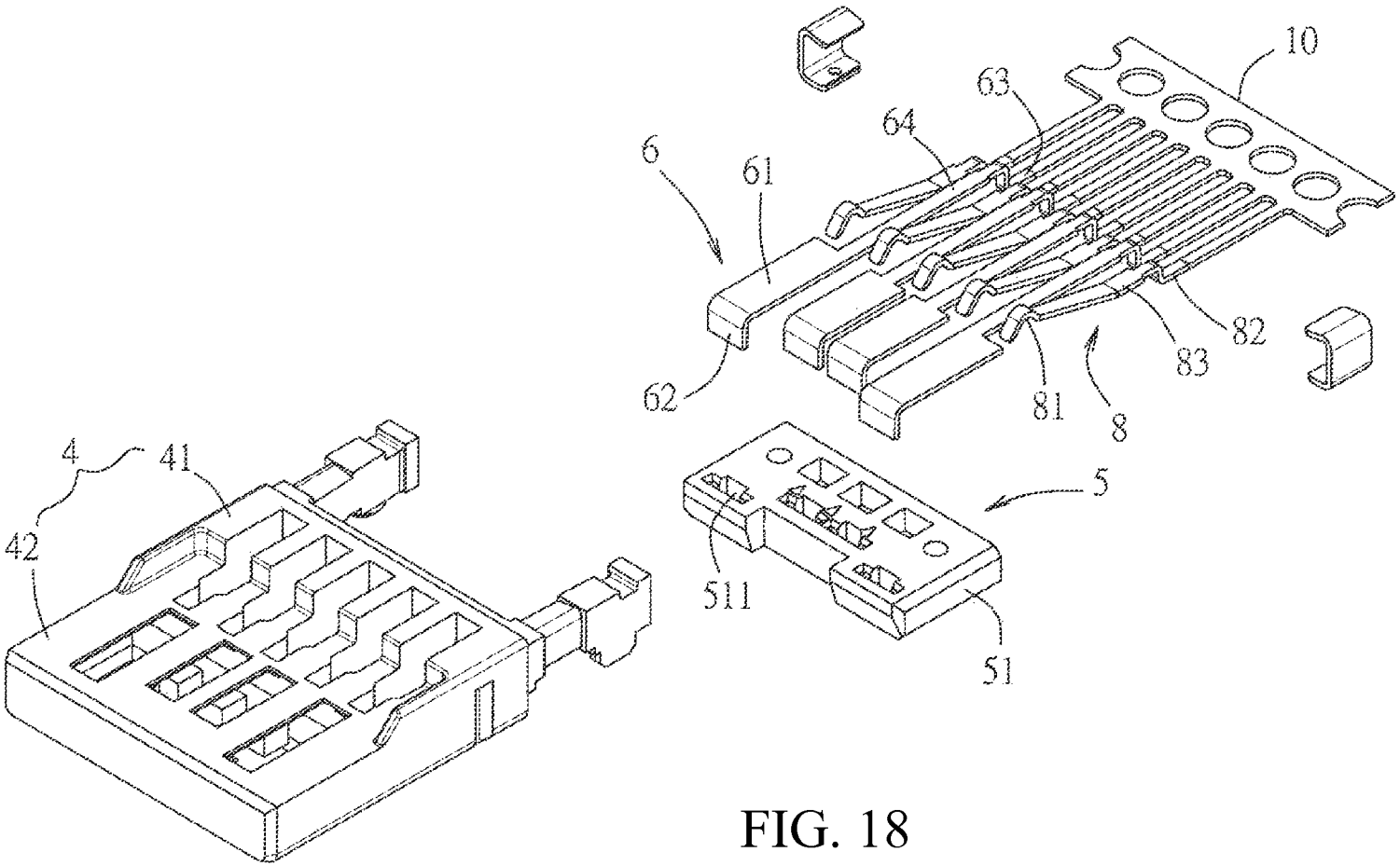
FIG. 18 illustrates an exploded perspective view of an embodiment of the electrical connector of FIG. 16, depicting an assembly relationship of the components.
Figure 19:
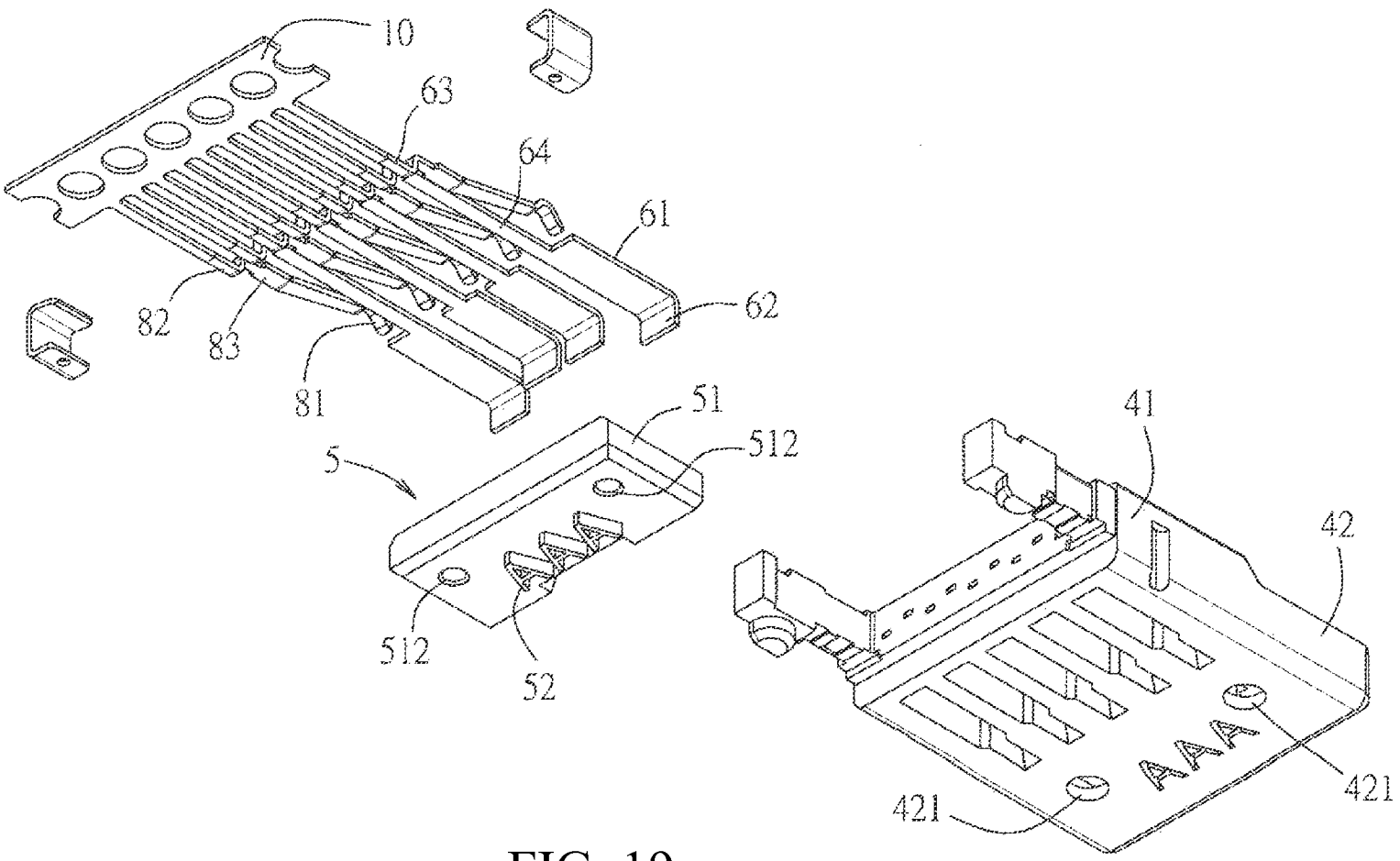
FIG. 19 illustrates another perspective view of the embodiment depicted in FIG. 18.
Figure 20:
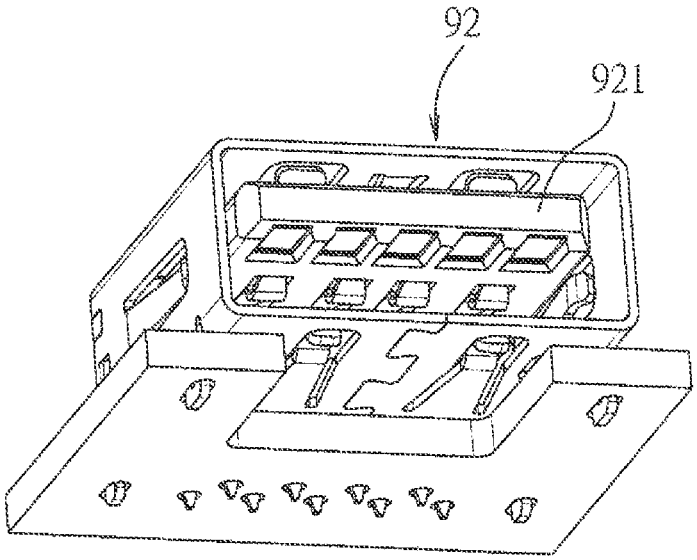
FIG. 20 illustrates a perspective view of a connector configured to mate with the electrical connector depicted in FIG. 16.

Referring to FIG. 11 to FIG. 13, an electronic device of a second embodiment of the present disclosure are substantially the same as that of the first embodiment, only in the second embodiment, the first end portion 11 and the second end portion 12 of the wear piece 1 are engaged by latching. The second end portion 12 further has a latch block 122 protruding into the receiving groove 121, and the tongue 42 has a latch groove 422 for latching of the latch block 122, in the embodiment, the latch groove 422 and the latch hole 421 are communicated with each other. In the embodiment, the ring body of the wear piece 1 is made of plastic, the first end portion 11 and the second end portion 12 are made of metal respectively, which may make the wear piece 1 more beautiful, but the first end portion 11 and the second end portion 12 may be also made of plastic.

Referring to FIG. 14 to FIG. 19, an electronic device of a third embodiment of the present disclosure comprises a shell 7, a circuit board 2 and an electrical connector 3.

The structure of the electrical connector 3 is substantially the same as that of the first embodiment, only in the third embodiment, the electrical connector 3 further comprises a plurality of second terminals 8 provided to the insulative housing 4, each second terminal 8 has an elastic contact portion 81, a tail portion 82 and a fixed portion 83 connecting the elastic contact portion 81 and the tail portion 82. From the surface of the tongue 42, the elastic contact portions 81 of the plurality of second terminals 8 and the contact portions 61 of the plurality of first terminals 6 are exposed at the same side, and are provided as two rows along the mating direction A. The plurality of first terminals 6 and the plurality of the second terminals 8 are fixed by a strip 10 in the molding process, and after the insulative housing 4 is formed, the strip 10 is removed. Similarly, the holding portions 62 of the plurality of first terminals 6 correspondingly extend into the holding holes 511 of the positioning member 5 respectively, and the plurality of contact portions 61 abut against the surface of the main body 51 so as to be held by the main body 51 of the positioning member 5.

Figure 21:
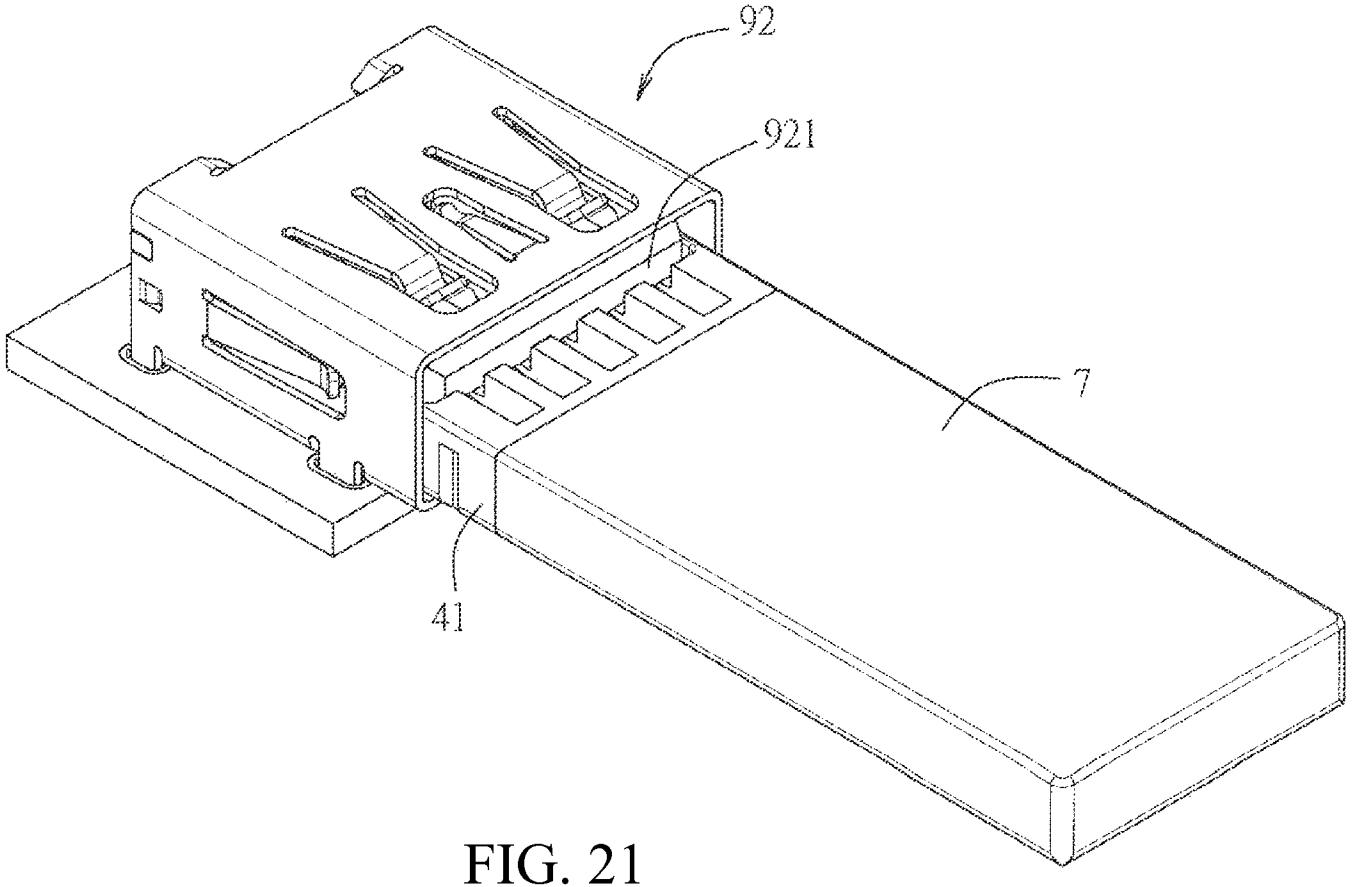
FIG. 21 illustrates a perspective view of the connector depicted in FIG. 20 mated to the electronic device depicted in FIG. 14.

The electrical connector 3 is provided to the circuit board 2 and is electrically connected to the circuit board 2, the shell 7 covers the circuit board 2 and a part of the electrical connector 3 so as to make the tongue 42 protrude relative to an end of the shell 7. Referring to FIG. 21, when the electrical connector 3 is mated with a mating connector 92, a front edge of the base portion 41 of the insulative housing 4 abuts against an outer edge of a tongue 921 of the mating connector 92 so as to make the electrical connector 3 and the mating connector 92 positioned relative to each other.

It can be understood that, the electrical connector of the first embodiment and the electrical connector of the second embodiment may be the same as the electrical connector of the third embodiment, that is the electrical connector of the first embodiment and the electrical connector of the second embodiment each also comprise a second terminal, and the electrical connector of the third embodiment may be also the same as the electrical connector of the first embodiment and the electrical connector of the second embodiment, that is the electrical connector of the third embodiment only has the first terminal. That is, the electronic devices of different embodiments may be adjusted in provisions of the terminals of the electrical connectors according to application requirements.

In conclusion, that the plurality of first terminals 6 are held by the positioning member 5 may reduce the number of the ejector pins in the molding process, and does not leave the pin holes on the tongue 42 at the two sides and the back surface of the contact portion 61 of the each first terminal 6 so as to make the structure of the tongue 42 integrated and beautiful. Furthermore, it seems that the display portion 52 of the positioning member 5 is embedded in the tongue 42, as such the display portion 52 is not easily worn to disappear. Furthermore, the colour of the display portion 52 may be different from the colour of the tongue 42 so as to highlight the display portion 52.

The above described are only the embodiments of the present disclosure, which cannot limit the scope of the implementation of the present disclosure, that is, simple equivalent variations and modifications made according to the scope of the Claims and the description content of the present disclosure are still fallen within the scope of the present disclosure.

What is claimed is:

1. An electrical connector, comprising:

an insulative housing having a tongue;

a positioning member embedded in the tongue and having a main body; and a plurality of first terminals held by the main body of the positioning member and embedded in the insulative housing, the tongue exposing a flat plate-like contact portion of each first terminal, wherein the main body of the positioning member has a plurality of holding holes, each first terminal further has a holding portion bent from an end of the contact portion and extending, the holding portions of the plurality of first terminals correspondingly extend into the plurality of holding holes respectively.

2. An electrical connector comprising:

an insulative housing having a tongue;

a positioning member embedded in the tongue and having a main body, the positioning member further has a display portion protruding from a surface of the main body, the display portion is far away from the surface of the main body and the tongue exposes the display portion; and a plurality of first terminals held by the main body of the positioning member and embedded in the insulative housing, the tongue exposing a flat plate-like contact portion of each first terminal.

3. The electrical connector of claim 2, wherein the display portion is character or graphics.

4. The electrical connector of claim 2, wherein a color of the display portion is different from a color of the tongue.

5. The electrical connector of claim 4, wherein the main body of the positioning member has a plurality of holding holes, each first terminal further has a holding portion bent from an end of the contact portion and extending, the holding portions of the plurality of first terminals correspondingly extend into the plurality of holding holes respectively.

6. The electrical connector of claim 5, wherein the main body of the positioning member further has two positioning holes positioned at two opposite sides of the plurality of holding holes, the tongue has two latch holes respectively corresponding to the two positioning holes in position.

7. The electrical connector of claim 4, further comprising:

a plurality of second terminals provided to the insulative housing, each second terminal having an elastic contact portion, from the surface of the tongue, the elastic contact portions of the plurality of second terminals and the contact portions of the plurality of first terminals are exposed at the same side.

8. The electrical connector of claim 7, wherein the main body of the positioning member has a plurality of holding holes, each first terminal further has a holding portion bent from an end of the contact portion and extending, the holding portions of the plurality of first terminals correspondingly extend into the plurality of holding holes respectively.

9. The electrical connector of claim 8, wherein the main body of the positioning member further has two positioning holes positioned at two opposite sides of the plurality of holding holes, the tongue has two latch holes respectively corresponding to the two positioning holes in position.

10. The electrical connector of claim 9, wherein the contact portions of the plurality of first terminals and the contact portions of the plurality of second terminals are provided as two rows along a mating direction.

11. An electronic device, comprising:

a circuit board;

an electrical connector of claim 2 positioned on and electrically connected to the circuit board; and a wear piece having a first end portion and a second end portion which are configured to be repeatedly engaged together, the wear piece being a ring shape when the first end portion and the second end portion are engaged, wherein the circuit board and the electrical connector are provided at the first end portion and the tongue protrudes from the first end portion, the second end portion having a receiving groove for receiving the tongue, and the tongue being received in the receiving groove when the first end portion and the second end portion are engaged.

12. An electronic device, comprising:

a circuit board;

an electrical connector of claim 1 provided to the circuit board and electrically connected to the circuit board; and a shell covering the circuit board and a part of the electrical connector so as to make the tongue protrude relative to an end of the shell.

13. The electronic device of claim 11, wherein the second end portion further has a latch block protruding into the receiving groove, and the tongue has a latch groove for latching of the latch block.

14. An electronic device, comprising:

a circuit board;

an electrical connector of claim 2 provided to the circuit board and electrically connected to the circuit board; and a shell covering the circuit board and a part of the electrical connector so as to make the tongue protrude relative to an end of the shell.

15. An electronic device, comprising:

a circuit board;

an electrical connector of claim 1 positioned on and electrically connected to the circuit board; and a wear piece having a first end portion and a second end portion which are configured to be repeatedly engaged together, the wear piece being a ring shape when the first end portion and the second end portion are engaged, wherein the circuit board and the electrical connector are provided at the first end portion and the tongue protrudes from the first end portion, the second end portion having a receiving groove for receiving the tongue, and the tongue being received in the receiving groove when the first end portion and the second end portion are engaged.

16. The electrical connector of claim 1, wherein the main body of the positioning member further has two positioning holes positioned at two opposite sides of the plurality of holding holes, the tongue has two latch holes respectively corresponding to the two positioning holes in position.

17. The electrical connector of claim 1, further comprising:

a plurality of second terminals provided to the insulative housing, each second terminal having an elastic contact portion, from the surface of the tongue, the elastic contact portions of the plurality of second terminals and the contact portions of the plurality of first terminals are exposed at the same side.

18. The electrical connector of claim 17, wherein the contact portions of the plurality of first terminals and the contact portions of the plurality of second terminals are provided as two rows along a mating direction.

* * * * *